US005267609A

United States Patent [19]

Olsson

[11] Patent Number: 5,267,609

[45] Date of Patent: Dec. 7, 1993

[54] HEAT RADIATION TUBE

[75] Inventor: Jan-Olof Olsson, Hallstahammar, Sweden

[73] Assignee: 501 Kanthal AB Box 502 S-734, Hallstahammar, Sweden

[21] Appl. No.: 280,003

[22] Filed: Dec. 5, 1988

[30] Foreign Application Priority Data

Dec. 4, 1987 Sweden .....8704859-1

[51] Int. Cl.[5] ..... F28F 13/18

[52] U.S. Cl. ..... 165/133; 373/127; 165/904

[58] Field of Search ..... 165/133; 122/DIG. 13; 219/354, 544, 553; 338/232-237; 373/127

[56] References Cited

U.S. PATENT DOCUMENTS 3,450,864 6/1969 Carlon ..... 219/553
3,596,057 7/1971 Arntz et al. ..... 219/354
4,597,734 7/1986 McCausland et al. ..... 431/328
4,780,276 10/1988 Barrett et al. ..... 420/54

FOREIGN PATENT DOCUMENTS 1317168 5/1973 United Kingdom .

*Primary Examiner*—Allen J. Flanigan
*Attorney, Agent, or Firm*—Cohen, Pontani, Lieberman, Pavane

[57] ABSTRACT

Heat radiation tubes for furnaces and the like heating devices, mainly for industrial processes.

Heating can be obtained by electrical heating elements or by combustion for example of gas. The radiation tube is a circular tube having end walls, flanges etc. as required.

The radiation tube is a seam-less tube made from iron-chromium-aluminum thereby greatly reducing oxide spalling and enhancing strength thereof at high temperatures. Preferably the tubes are made by extrusion whereby conditions are chosen to provide a rough surface with grooves and ridges which further improves the adhesion of the oxide layer.

2 Claims, 2 Drawing Sheets

HEAT RADIATION TUBE

FIELD OF THE INVENTION

The present invention relates to a heat radiation tube for furnaces and the like heating apparatus and specifically to a heat radiation tube made from FeCrAl-alloys. The source of heat can be an electrical resistance element or a burner using for example gas. The term furnace herein primarily means a furnace for heat treatment in industrial processes.

BACKGROUND OF THE INVENTION

Heat radiation tubes are mainly used in furnaces where the furnace atmosphere does not allow direct heat. This can be due to the atmosphere being harmful to the elements which are being used for electrical heating or due to the desire to control the atmosphere in the furnace whereby combustion gases are not allowed therein. Other reasons for the use of radiation tubes instead of direct heating where such should be possible might be for example that one wants to repair or exchange the heat source while the furnace is being used. It will then be easier to do this in a separate space, e.g. inside the radiation tube, than in the furnace chamber itself.

A heat radiation tube may comprise a cylindrical tube. A bottom or end plate is mounted in one end of the tube. In the other end of the tube there is, as a rule, a flange for mounting to the furnace wall. The tube can also have other arrangements, protrusions, etc. for mounting in the furnace as well as distance pieces and the like. Mainly when heating is obtained by combustion there may be inserts in the tube forming flow channels for the combustion gases. U-shaped radiation tubes may also be used.

Radiation tubes have hitherto mainly been used at furnace temperatures up to about 1100° C. The known tubes are often made from an alloy mainly comprising nickel, chromium and iron. The alloy composition is for example 40–60 weight % nickel, 15–20% chrome and 25–45% iron. These radiation tubes, however, have certain drawbacks which are of great importance in most applications. On the outside as well as the inside surface of the tubes oxide layers are formed which are spalled off when they have reached a certain thickness, which varies due to conditions in each application. In these tubes the oxide layers fail to provide a protective layer. Falling oxide flakes may cause problems if they get into contact with the products present inside the furnace. However, the greatest problems are caused by the oxide flakes on the inside surface of the tubes. If these surfaces are holding electrical heating elements, the oxide flakes may cause short-circuiting between separate elements and between separate parts of one element which brings with it an immediate interruption of the function of the element or a considerably decreased useful life of the element. When an element is exchanged, which means that element and element support is pulled out from the radiation tube and after repair or exchange is again reinserted into it, the supports may function as scrapers and cause large amounts of oxides to accumulate in most cases in the distant end of the tube which may cause difficulties during the repair work and cause malfunctions.

Hitherto used radiation tubes do not have satisfactory mechanical properties at high temperatures. Due to their own weight and the internal load the tubes tend to sag. In order to compensate for this sagging the tubes have to be turned 180° at regular intervals. This can, in most cases, be made in connection with normal maintenance or repair but it is still an essential drawback and a factor which limits the possibilities of use.

SUMMARY OF THE INVENTION

The object of the present invention is to avoid the above-mentioned drawbacks of hitherto known radiation tubes and to enable the use thereof at higher temperatures than has hitherto been possible. This mainly refers to a higher constant temperature at continuous use. The invention also makes it possible to have longer intervals between shut downs for maintenance work. Also, the substantially reduced or totally eliminated sagging of the tubes largely increases the reliability of the radiation tubes as well enables easier maintenance thereof.

Radiation tubes according to the invention are intended for use in furnaces and the like heating apparatus and are characterized in that the tube is made from an alloy of the FeCrAl-type and that the cylindrical part thereof is a seamless tube. The radiation tubes of the invention have important advantages compared to conventional tubes made by casting or welding of plates from nickel chromium or iron-nickel-chromium-alloys. Radiation tubes according to the invention can be used at temperatures up to about 1250°–1300° C.

At high temperatures and oxidizing conditions FeCrAl-alloys form a stable and adhering layer of aluminum oxide on the surface of the material. This oxide is also more heat resistant and resistant against chemical attacks than the layers which are formed on nickel-chromium-alloys. This is particularly true in sulphur containing environments, where rapid and severe attacks are experienced on nickel-chromium material. Provided the oxide layer is undamaged the FeCrAl-alloys also perform better in a carburating atmosphere. In many applications it is therefore important to pre-oxidize the radiation tubes according to the invention. This shall be done also if the intended temperature of use is below about 1100° C. Suitable oxidation is obtained for example by heat treatment in air at about 1100° C. for at least 8 hours. The FeCrAl-alloy may also contain minor amounts of other alloying components such as yttrium, titanium and zirconium in amounts up to 0.2 weight % of each. These additives influence the oxide layers as well as the structure and properties of the material.

The cylindrical tube which is a main part of the radiation tube is seam-less and preferably made by extrusion. The slab which is used for the extrusion is made in a well-known way by casting or by powder metallurgy. The shearing speed and other conditions of extrusion are chosen to give the tubes a striped surface which means that all of the outer surface of the tube is rough with axially extending irregular grooves and ridges, the size of which is chosen to optimize the properties of the oxide layer, mainly its strength and elasticity, in order to avoid oxide spalling by high and changing temperatures.

BRIEF DESCRIPTION OF THE DRAWINGS

The invention will be further described with reference to the accompanying figures.

FIG. 1 shows several radiation tubes (1, 2A, 2B) which have been mounted into a furnace having a brick wall (3). The radiation tubes have a sheath which is a cylindrical tube (9) made from FeCrAl material. FeCrAl material means iron-chromium-aluminum-alloys as described above. At the outer end of the tube is an end plate or wall (not shown) made from the same material. In the wall (3) of the furnace there is provided a hole which corresponds to the tube and wherein the end of the tube is supported. For the other end of the tube (not shown) there is a corresponding support, for example, a shelf or an opening in the furnace wall. The distance between the walls of the furnace can be up to 2 meters and the radiation tube is mounted unsupported therein. Inside the tube there is an electrical resistance element (4) which in the example shown is made of $MoSi_2$ of the kind which is marketed under the trademark KANTHAL SUPER. The element is resting on a ceramic support (5). The terminal parts (7) of the element pass through two plugs (6, 8), which separate the hot atmosphere of the radiation tube from the surrounding and support the terminal parts.

Figure 2:
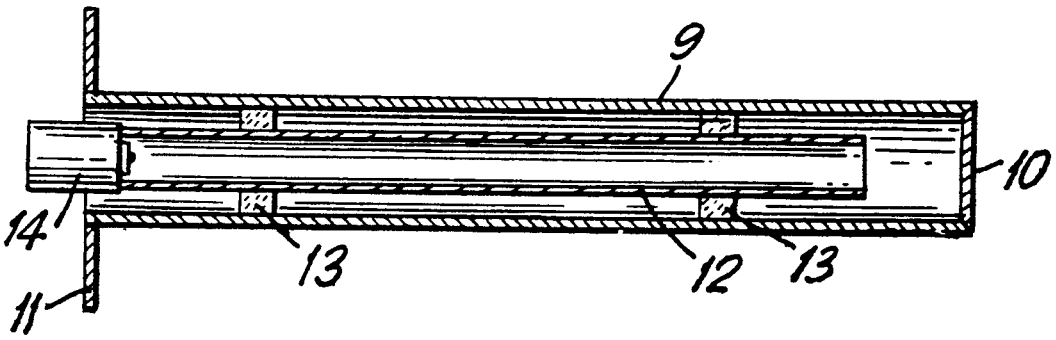
FIG. 2 shows a cross section through a radiation tube which is heated by combustion of gas.

The radiation tube shown in FIG. 2 is intended to be heated by an indicated gas burner (14). The combustion gases from the burner flow firstly through the insert (12), make a turn at the wall (10) and flow back along the radiation tube (9). The latter has a flange (11) for mounting to the furnace wall in a conventional way. Supports (13) are welded to the insert.

Figure 1:
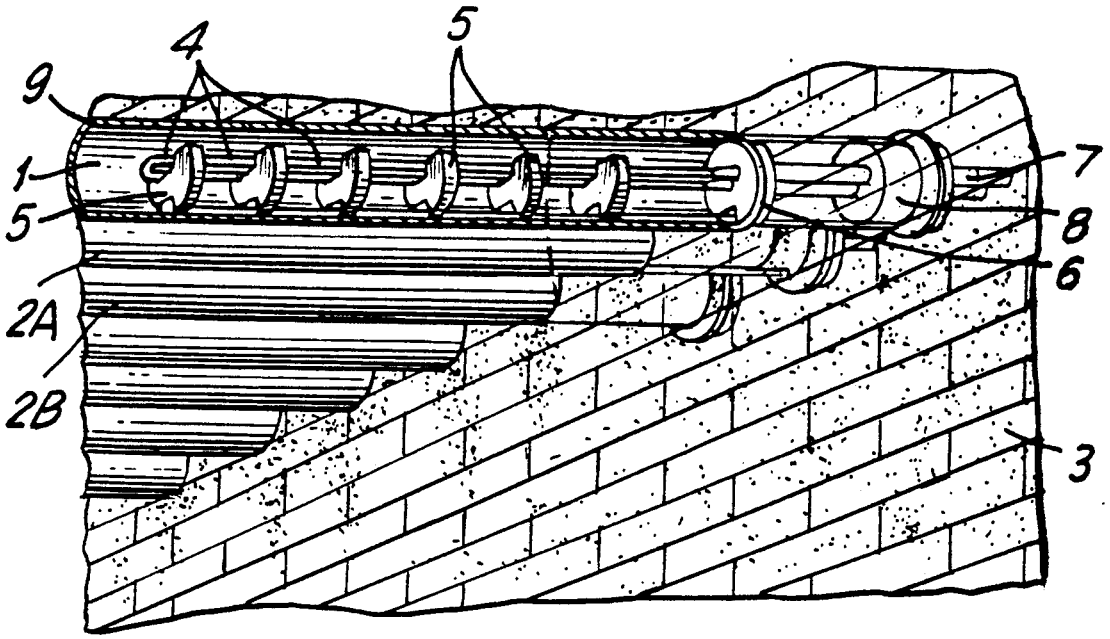
FIG. 1 shows electrically heated radiation tubes inside a furnace. One of the radiation tubes is shown with part of the tube cut away in order to show the element.

The radiation tubes shown in FIGS. 1 and 2 have dimensions chosen with respect to the furnace wherein they are to be used. For example the length of the tube may be 1800 mm, its external diameter 200 mm and wall thickness 8 mm. The tubes may, however, be of any other suitable dimensions.

Figure 3:
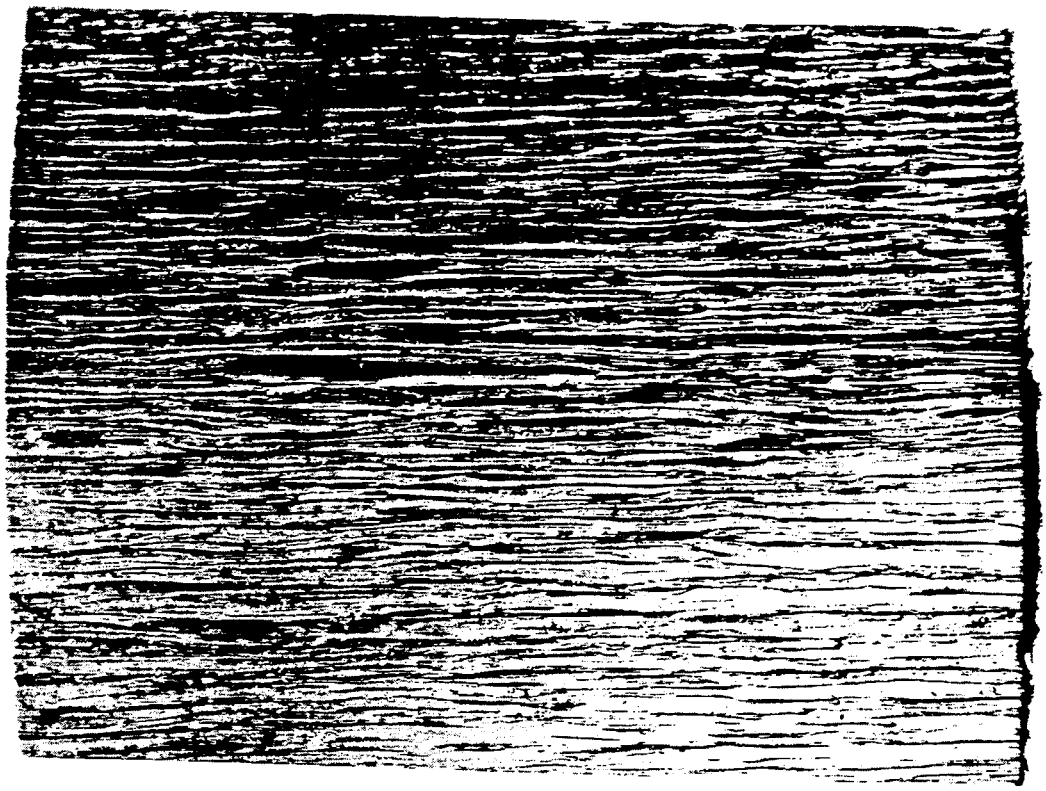
FIG. 3 shows the surface of the cylindrical tube of a radiation tube.
Figure 4:
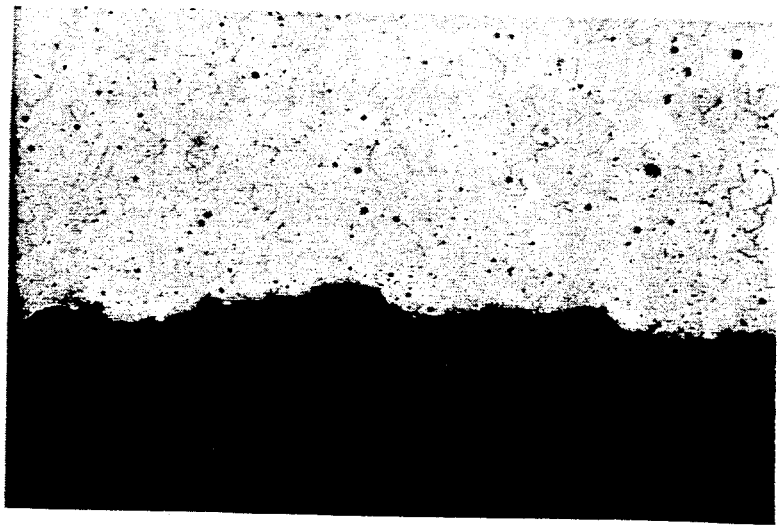
FIG. 4 shows a cross section of the cylindrical tube.

FIGS. 3 and 4 show the appearance of a radiation tube according to the invention. FIG. 3 is a photograph of the surface of the tube and FIG. 4 shows a cross section of the same surface of the tube at about 50 times magnification. The striped appearance of the surface is shown in the pictures. These crystal stripes are obtained by the use of a sufficient high shearing speed during the extrusion process and substantially improve the properties of the oxide layer.

It should be understood that the preferred embodiments described above are for illustrative purpose only and are not to be construed as limiting the scope of the invention which is properly delineated only in the appended claims.

What is claimed is:

1. A radiation tube for furnaces and like heating apparatus, characterized in that the tube is made from a FeCrAl alloy, the cylindrical part thereof is seam-less, and the surface of the tube is rough having irregular grooves and ridges extending axially along the tube.

2. The radiation tube according to claim 1, characterized in that the outer surface of the tube has been covered by oxidation with an oxide layer comprising aluminum oxide.

* * * * *

UNITED STATES PATENT AND TRADEMARK OFFICE

CERTIFICATE OF CORRECTION

PATENT NO. : 5,267,609

DATED : December 7, 1993

INVENTOR(S) : Jan-Olof Olsson

It is certified that error appears in the above-identified patent and that said Letters Patent is hereby corrected as shown below:

On the title page item (73) Assignee;

should read as follows; Kanthal AB

Signed and Sealed this

Eighteenth Day of October, 1994

*Attest:*

*Attesting Officer*

BRUCE LEHMAN

*Commissioner of Patents and Trademarks*